US010973263B2

(12) United States Patent
Fursa

(10) Patent No.: US 10,973,263 B2
(45) **Date of Patent: *Apr. 13, 2021**

(54) AEROSOL-GENERATING ARTICLE

(71) Applicant: PHILIP MORRIS PRODUCTS S.A., Neuchatel (CH)

(72) Inventor: Oleg Fursa, Gempenach (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 239 days.

This patent is subject to a terminal disclaimer.

(21) Appl. No.: 16/090,896

(22) PCT Filed: Apr. 10, 2017

(86) PCT No.: PCT/EP2017/058479

§ 371 (c)(1),
(2) Date: Oct. 3, 2018

(87) PCT Pub. No.: WO2017/178394

PCT Pub. Date: Oct. 19, 2017

(65) Prior Publication Data

US 2019/0124981 A1 May 2, 2019

(30) Foreign Application Priority Data

Apr. 11, 2016 (EP) ..... 16164680

(51) Int. Cl.

| | |
|---|---|
| ***A24F 40/465*** | (2020.01) |
| ***A24F 40/20*** | (2020.01) |
| ***A24F 40/46*** | (2020.01) |
| ***A24F 42/10*** | (2020.01) |
| ***A24F 47/00*** | (2020.01) |

(52) U.S. Cl.
CPC ..... *A24F 47/008* (2013.01); *A24F 40/20* (2020.01); *A24F 40/46* (2020.01); *A24F 40/465* (2020.01); *A24F 42/10* (2020.01); *A24F 47/006* (2013.01)

(58) Field of Classification Search
CPC ..... A24F 47/008; A24F 47/006; A24F 42/20; A24F 42/10; A24F 40/465; A24F 40/46
See application file for complete search history.

(56) References Cited

FOREIGN PATENT DOCUMENTS

| | | |
|---|---|---|
| EP | 0 430 566 | 6/1991 |
| WO | 95/27411 | 10/1995 |
| WO | 2012/164009 | 12/2012 |
| WO | 2015/071682 | 5/2015 |
| WO | 2015/176898 | 11/2015 |

(Continued)

OTHER PUBLICATIONS

PCT International Search Report and Written Opinion for PCT/EP2017/058479 dated Jul. 17, 2017 (15 pages).

(Continued)

*Primary Examiner* — Eric Yaary
*Assistant Examiner* — Jennifer A Kessie
(74) *Attorney, Agent, or Firm* — Oblon, McClelland, Maier & Neustadt, L.L.P.

(57) ABSTRACT

Aerosol-generating article (10) comprising a plurality of elements assembled in the form of a rod, the plurality of elements comprising an aerosol-forming substrate element (20), with an aerosol-forming substrate bulk (22) and with a susceptor material (25) arranged within the aerosol-forming substrate element, wherein the susceptor material comprises an aerosol-forming substrate coating (21).

15 Claims, 1 Drawing Sheet

(56) References Cited

FOREIGN PATENT DOCUMENTS

| | | |
|---|---|---|
| WO | 2015/177265 | 11/2015 |
| WO | 2017/068092 | 4/2017 |
| WO | 2017/068094 | 4/2017 |
| WO | 2017/068096 | 4/2017 |

OTHER PUBLICATIONS

International Preliminary Report on Patentability for PCT/EP2017/058479 dated Mar. 14, 2018 (7 pages).

AEROSOL-GENERATING ARTICLE

The invention relates to aerosol-generating articles and an aerosol-generating system comprising such aerosol-generating articles. In particular, the invention relates to inductively heatable aerosol-generating articles.

From prior art inductively heatable aerosol-generating articles comprising an aerosol-forming substrate and an elongate susceptor arranged within the aerosol-forming substrate are known. For example, the international patent publication WO 2015/176898 discloses an aerosol-generating article having an elongate susceptor arranged in an aerosol-forming substrate plug. The aerosol-generating article is adapted to be used in an electrically operated aerosol-generating device comprising an inductor for generating heat in the elongate susceptor for heating the surrounding aerosol-forming substrate. In order for the aerosol-forming substrate to be initially heated to a temperature required for aerosol formation, a pre-heating time may be rather long, for example, up to 30 seconds.

Thus, there is need for an aerosol-generating article having a shortened pre-heating time.

According to the invention there is provided an aerosol-generating article comprising a plurality of elements assembled in the form of a rod. The rod has a mouth end and a distal end upstream from the mouth end. The plurality of elements comprises an aerosol-forming substrate element with an aerosol-forming substrate bulk and with a susceptor material arranged within the aerosol-forming substrate element. The susceptor material comprises an aerosol-forming substrate coating.

The coating of susceptor material with aerosol-forming substrate provides a very close and direct physical contact between the substrate coating and the susceptor material. Thus, heat transfer from the susceptor material to the coating is optimized. The close contact leads to a fast heating up of the coating and thus to fast aerosol-formation from the aerosol-forming substrate of the coating. This leads to a short time to a first puff of an aerosol-generating device the article is used with.

By the provision of a substrate coating on susceptor material, a means has been found to directly and efficiently heat a preferably small portion of aerosol-forming substrate quickly such as to reduce preheating time for a first puff. The reduced preheating time may also reduce an amount of energy required in a device to get ready for use, which may in particular be advantageous in view of longer operation time of the device or in view of battery capacity or battery size of an electronic heating device.

Depending on form or size of the susceptor material, and also on composition and amount of an aerosol-forming substrate coating the susceptor material, a dosing regime may be chosen and varied according to a user's needs, for example, to achieve a specific consuming experience. The specific consuming experience may be varied by varying, for example, the size and shape of the susceptor material to be coated, and additionally or alternatively by varying, for example an amount or composition of the aerosol-forming substrate coating. Preferably, a dosing regime and by this an amount of coating is selected as small as possible to be heated as quickly as possible and as large as required to provide a first puff, preferably a first puff having a desired user's experience.

The susceptor material may be a plurality of susceptor particles, such as susceptor granules or susceptor flakes. The coated susceptor particles may be homogenously distributed in the aerosol-forming substrate element, in particular homogeneously distributed in the aerosol-forming substrate bulk. The coated susceptor particles may also be localized in a specific region of the aerosol-forming substrate element.

Susceptor particles may, for example, have a round or flat shape, have a regular or irregular shape or surface. A susceptor granule may for example be a susceptor bead or susceptor grit. Particles may be granules or flakes, for example having round or flat shapes, having regular or irregular shapes or surfaces. Granules may for example be beads or grit.

A granule is herein defined as being an element having a shape, wherein any dimension is smaller than twice of any other dimension. The shape may be round, substantially round or angular. A surface of the granule may be angular, rough or smooth.

A flake is herein defined as being an element having a shape having one predominant dimension, which predominant dimension is at least twice as large as any other dimension. Preferably, a flake has at least one surface that is substantially flat.

The susceptor material may be an elongate susceptor arranged longitudinally within the aerosol-forming substrate element. Preferably, such an elongate susceptor is arranged radially centrally within the aerosol-forming substrate element, preferably radially centrally within the aerosol-forming substrate bulk.

An elongate susceptor has a length dimension that is greater than its width dimension or its thickness dimension, for example greater than twice its width dimension or its thickness dimension. Thus the susceptor may be described as an elongate susceptor. The elongate susceptor is arranged substantially longitudinally within the rod. This means that the length dimension of the elongate susceptor is arranged to be approximately parallel to the longitudinal direction of the rod, for example within plus or minus 10 degrees of parallel to the longitudinal direction of the rod. In preferred embodiments, wherein the elongate susceptor is positioned in a radially central position within the rod, it extends along the longitudinal axis of the rod.

Preferably, the elongate susceptor is in the form of a pin, rod, strip or blade. Preferably, the elongate susceptor has a length between 5 millimeter and 15 millimeter, for example, between 6 mm and 12 mm, or between 8 mm and 10 mm. A lateral extension of a susceptor material may, for example, be between 0.5 mm and 8 mm, preferably between 1 mm and 6 mm, for example 4 millimeter. The elongate susceptor preferably has a width between 1 mm and 5 mm and may have a thickness between 0.01 mm and 2 mm, for example between 0.5 mm and 2 mm. In a preferred embodiment the elongate susceptor may have a thickness between 10 micrometer and 500 micrometer, or even more preferably between 10 and 100 micrometer. If the elongate susceptor has a constant cross-section, for example a circular cross-section, it has a preferable width or diameter between 1 millimeter and 5 millimeter. If the elongate susceptor has the form of a strip or blade, for example, is made of a sheet-like susceptor material, the strip or blade preferably has a rectangular shape having a width preferably between 2 millimeter and 8 millimeter, more preferably, between 3 mm and 5 mm, for example 4 mm and a thickness preferably between 0.03 millimeter and 0.15 millimeter, more preferably between 0.05 mm and 0.09 mm, for example 0.07 mm.

Preferably, the elongate susceptor has a length which is the same or shorter than the length of the aerosol-forming substrate element. Preferably, the elongate susceptor has a same length as the aerosol-forming substrate element.

As used herein, the term 'susceptor' refers to a material that can convert electromagnetic energy into heat. When located within a fluctuating electromagnetic field, typically eddy currents are induced and hysteresis losses occur in the susceptor causing heating of the susceptor. As the susceptor material is in direct physical and thermal contact with the aerosol-forming substrate coating and in thermal contact with the aerosol-forming substrate bulk, the aerosol-forming substrate coating is heated first by the susceptor material and the aerosol-forming substrate bulk is heated subsequently by the susceptor material. A transfer of heat is best, if the susceptor material is in close thermal contact, preferably close physical contact, with tobacco material and aerosol former of the aerosol-forming substrate coating. Due to a coating process, a close interface between susceptor material and aerosol-forming substrate coating is formed.

In embodiments wherein the elongate susceptor has a flat shape forming two large sides, for example wherein the elongate susceptor is a strip or blade, the aerosol-forming substrate coating is provided on at least one of the two large sides of the elongate susceptor. The aerosol-forming substrate coating may be provided on only one or on both of the two large sides of the elongate susceptor.

Susceptor material may be entirely coated with the aerosol-forming substrate coating.

Preferably, susceptor material comprises a single aerosol-forming substrate coating.

Where a coating is applied on the susceptor material, the effect may be dependent on a desired amount of aerosol-forming substrate coating, the form and amount of susceptor material arranged within the aerosol-forming substrate bulk, as well as on the coating process the susceptor material is treated.

The coating of the susceptor material may be performed by known coating processes suitable for coating a susceptor material with aerosol-forming substrate slurry.

Preferably, the aerosol-forming substrate coating on the susceptor material is performed by one of deposition, dip-coating, spraying, painting or casting of aerosol-forming substrate slurry onto an uncoated susceptor material.

These coating methods are standard reliable industrial processes that allow for mass production of coated objects. These coating processes also enable high product consistency in production and repeatability in performance of the aerosol-generating articles.

A thickness of the aerosol-forming substrate coating may be between 50 micrometer and 120 micrometer, preferably between 60 and 100 micrometer, the thickness may for example be below 100 micrometer, such as for example between 50 and 90 micrometer. In a preferred embodiment, a coating in the above mentioned thickness range is provided on one of the two large sides of an elongate susceptor. A coating in the above mentioned thickness range may additionally be provided also on the other one of the two large sides of the elongate susceptor.

The susceptor material, preferably an elongate susceptor, comprises a surface area of at least 30 $mm^2$, which is coated with aerosol-forming substrate coating. Preferably, a coated surface area of susceptor material covers at least 45 $mm^2$, for example a surface area between 30 $mm^2$ and 120 $mm^2$, or for example a surface area between 40 $mm^2$ and 80 $mm^2$.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be formed from 400 series stainless steels, for example grade 410, or grade 420, or grade 430 stainless steel. Different materials will dissipate different amounts of energy when positioned within electromagnetic fields having similar values of frequency and field strength. Thus, parameters of the susceptor such as material type, length, width, and thickness may all be altered to provide a desired power dissipation within a known electromagnetic field.

Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor may be a multi-material susceptor and may comprise a first susceptor material and a second susceptor material. The first susceptor material is disposed in intimate physical contact with the second susceptor material. The second susceptor material preferably has a Curie temperature that is lower than 500° C. The first susceptor material is preferably used primarily to heat the susceptor when the susceptor is placed in a fluctuating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Thus, the Curie temperature of the second susceptor material should be below the ignition point of the aerosol-forming substrate of the coating as well as of the substrate bulk. Suitable materials for the second susceptor material may include nickel and certain nickel alloys.

By providing a susceptor having at least a first and a second susceptor material, with either the second susceptor material having a Curie temperature and the first susceptor material not having a Curie temperature, or first and second susceptor materials having first and second Curie temperatures distinct from one another, the heating of the aerosol-forming substrate coating and the aerosol-forming substrate bulk and the temperature control of the heating may be separated. The first susceptor material is preferably a magnetic material having a Curie temperature that is above 500° C. It is desirable from the point of view of heating efficiency that the Curie temperature of the first susceptor material is above any maximum temperature that the susceptor should be capable of being heated to. The second Curie temperature may preferably be selected to be lower than 400° C., preferably lower than 380° C., or lower than 360° C. It is preferable that the second susceptor material is a magnetic material selected to have a second Curie temperature that is substantially the same as a desired maximum heating temperature. That is, it is preferable that the second Curie temperature is approximately the same as the temperature that the susceptor should be heated to in order to generate an aerosol from the aerosol-forming substrate coating and from the aerosol-forming substrate bulk. The second Curie temperature may, for example, be within the range of 200° C. to 400° C., or between 250° C. and 360° C. The second Curie temperature of the second susceptor material may, for example, be selected such that, upon being heated by a susceptor that is at a temperature equal to the second Curie temperature, an overall average temperature of the aerosol-forming substrate coating as well as of the aerosol-forming substrate bulk does not exceed 240° C.

The aerosol-forming substrate is a solid aerosol-forming substrate. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

The aerosol-forming substrate bulk may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The aerosol-forming substrate bulk may be in loose form, or may be provided in a suitable container or cartridge. For example, the aerosol-forming material of the aerosol-forming substrate bulk may be contained within a paper or other wrapper and have the form of a plug. Where an aerosol-forming substrate bulk is in the form of a wrapped plug, the entire plug, including the coated susceptor material and including any wrapper forms the aerosol-forming substrate element.

Optionally, the aerosol-forming substrate may contain additional tobacco or non-tobacco volatile flavour compounds, to be released upon heating of the aerosol-forming substrate. The solid aerosol-forming substrate bulk may also contain capsules that, for example, include the additional tobacco or non-tobacco volatile flavour compounds and such capsules may melt during heating of the solid aerosol-forming substrate bulk.

The aerosol-forming substrate bulk may comprise one or more sheets of homogenised tobacco material that has been gathered into a rod, circumscribed by a wrapper, and cut to provide individual plugs of aerosol-forming substrate. Into this or these gathered, rod-shaped sheets the coated susceptor material is introduced before, during or after gathering the sheet into a rod. Preferably, the aerosol-forming substrate bulk comprises a crimped and gathered sheet of homogenised tobacco material.

The aerosol-forming substrate element and bulk may be substantially cylindrical in shape. The aerosol-forming substrate element and bulk may be substantially elongate. The aerosol-forming substrate element and bulk may also have a length and a circumference substantially perpendicular to the length.

Further, the aerosol-forming substrate element and bulk may have a length of 10 millimeter. Alternatively, the aerosol-forming substrate element and bulk may have a length of 12 millimeter. Further, the diameter of the aerosol-forming substrate element and bulk may be between 5 millimeter and 12 millimeter.

Tobacco containing slurry and a tobacco sheet forming the aerosol-forming substrate bulk as well as a coating made from the tobacco containing slurry comprises tobacco particles, fiber particles, aerosol former, binder and for example also flavours.

Preferably, the aerosol-forming tobacco substrate bulk is a tobacco sheet, preferably crimped, comprising tobacco material, fibers, binder and aerosol former. Preferably, the tobacco sheet is a cast leaf. Cast leaf is a form of reconstituted tobacco that is formed from a slurry including tobacco particles, fiber particles, aerosol former, binder and for example also flavours.

Preferably, a coating is a form of reconstituted tobacco that is formed from the tobacco containing slurry.

Tobacco particles may be of the form of a tobacco dust having particles in the order of 30 micrometers to 250 micrometers, preferably in the order of 30 micrometers to 80 micrometers or 100 micrometers to 250 micrometers, depending on the desired coating thickness or an a desired sheet thickness and casting gap, where the casting gap typically defined the thickness of the sheet.

Fiber particles may include tobacco stem materials, stalks or other tobacco plant material, and other cellulose-based fibers such as wood fibers having a low lignin content. Fiber particles may be selected based on the desire to produce a sufficient tensile strength for the coating or sheet versus a low inclusion rate, for example, an inclusion rate between approximately 2 percent to 15 percent. Alternatively, fibers, such as vegetable fibers, may be used either with the above fiber particles or in the alternative, including hemp and bamboo.

Aerosol formers included in the slurry for forming the cast leaf and the coating may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. An aerosol former may be chosen based on its ability, for example, to remain stable at or around room temperature but able to volatize at a higher temperature, for example, between 40 degree Celsius and 450 degree Celsius. The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

One or more aerosol former may be combined to take advantage of one or more properties of the combined aerosol formers. For example, triacetin may be combined with glycerol and water to take advantage of the triacetin's ability to convey active components and the humectant properties of the glycerol.

Aerosol formers may be selected from the polyols, glycol ethers, polyol ester, esters, and fatty acids and may comprise one or more of the following compounds: glycerol, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

A typical process to produce a cast leaf or a slurry for an aerosol-forming substrate coating includes the step of preparing the tobacco. For this, tobacco is shredded. The shredded tobacco is then blended with other kinds of tobacco and grinded. Typically, other kinds of tobacco are other types of tobacco such as Virginia or Burley, or may for example also be differently treated tobacco. The blending and grinding steps may be switched. The fibers are prepared separately and preferably such as to be used for the slurry in the form of a solution. Since fibers are mainly present in the slurry for providing stability to a cast leaf or a coating, the amount of fibers may be reduced or fibers may even be omitted in a coating due to the aerosol-forming substrate coating being stabilized by the susceptor material.

If present, the fiber solution and the prepared tobacco are then mixed. The slurry may then be transferred to a coating device, for example a sheet forming apparatus or deposition device.

After coating, the aerosol-forming substrate is then dried, preferably by heat and cooled after drying.

Preferably, the tobacco containing slurry comprises homogenized tobacco material and comprises glycerol or propylene glycol as aerosol former. Preferably, the aerosol-forming substrate bulk and aerosol-forming substrate coating is made of a tobacco containing slurry as described above.

Advantageously, an aerosol-forming substrate coating the susceptor is porous to allow volatilized substances to leave the substrate. Due to the aerosol-forming substrate coating having close contact to the susceptor material, only the small amount of aerosol-forming substrate coating must initially be heated by the susceptor material. Thus, also coatings having no or only little porosity may be used. A coating with small thickness may, for example, be chosen to have less porosity than a coating with larger thickness.

Alternatively, a thickness of an aerosol-forming substrate coating may be between 80 micrometer and 1 millimeter, preferably between 100 micrometer and 600 micrometer, for example between 100 micrometer and 400 micrometer. In particular, the before mentioned thickness ranges are preferred if only one-sided coatings and coatings with high porosity is used.

As a general rule, whenever a value is mentioned throughout this application, this is to be understood such that the value is explicitly disclosed. However, a value is also to be understood as not having to be exactly the particular value due to technical considerations. A value may, for example, include a range of values corresponding to the exact value plus or minus 20 percent.

The aerosol-generating article may comprise further elements, such as for example a mouthpiece element, a support element and an aerosol-cooling element.

The mouthpiece element may be located at the mouth end or downstream end of the aerosol-generating article.

The mouthpiece element may comprise at least one filter segment. The filter segment may be a cellulose acetate filter plug made of cellulose acetate tow. A filter segment may have low particulate filtration efficiency or very low particulate filtration efficiency. A filter segment may be longitudinally spaced apart from the aerosol-forming substrate element. The filter segment is 7 millimeter in length in one embodiment, but may have a length of between 5 millimeter and 14 millimeter.

A mouthpiece element is the last portion in the downstream direction of the aerosol-generating article. A user contacts the mouthpiece element in order to pass an aerosol generated by the aerosol-generating article through the mouthpiece element to the user. Thus, a mouthpiece element is arranged downstream of an aerosol-forming substrate element.

The mouthpiece element preferably has an external diameter that is approximately equal to the external diameter of the aerosol-generating article. The mouthpiece element may have an external diameter of between 5 millimeter and 10 millimeter, for example of between 6 mm and 8 mm. In a preferred embodiment, the mouthpiece element has an external diameter of 7.2 mm plus or minus 10 percent. The mouthpiece element may have a length of between 5 millimeter and 25 millimeter, preferably a length of between 10 mm and 17 mm. In a preferred embodiment, the mouthpiece element has a length of 12 mm or 14 mm. In another preferred embodiment, the mouthpiece element has a length of 7 mm.

A support element may be located immediately downstream of the aerosol-forming substrate element and may abut the aerosol-forming substrate element.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate.

The support element may comprise a hollow tubular element. In a preferred embodiment, the support element comprises a hollow cellulose acetate tube.

The support element preferably has an external diameter that is approximately equal to the external diameter of the aerosol-generating article.

The support element may have an external diameter of between 5 mm and 12 mm, for example of between 5 mm and 10 mm or of between 6 mm and 8 mm. In a preferred embodiment, the support element has an external diameter of 7.2 mm plus or minus 10 percent. The support element may have a length of between 5 mm and 15 mm. In a preferred embodiment, the support element has a length of 8 mm.

An aerosol-cooling element may be located downstream of the aerosol-forming substrate element, for example immediately downstream of a support element, and may abut the support element.

The aerosol-cooling element may be located between the support element and a mouthpiece element located at the extreme downstream end of the aerosol-generating article.

As used herein, the term 'aerosol-cooling element' is used to describe an element having a large surface area and a low resistance to draw. In use, an aerosol formed by volatile compounds released from the aerosol-forming substrate is drawn through the aerosol-cooling element before being transported to the mouth end of the aerosol-generating article. In contrast to high resistance-to-draw filters, for example filters formed from bundles of fibers, aerosol-cooling elements have a low resistance to draw. Chambers and cavities within an aerosol-generating article such as expansion chambers and support elements are also not considered to be aerosol cooling elements.

An aerosol-cooling element preferably has a porosity in a longitudinal direction of greater than 50 percent. The airflow path through the aerosol-cooling element is preferably relatively uninhibited. An aerosol-cooling element may be a gathered sheet or a crimped and gathered sheet. An aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil or any combination thereof.

In a preferred embodiment, the aerosol-cooling element comprises a gathered sheet of biodegradable material. For example, a gathered sheet of non-porous paper or a gathered sheet of biodegradable polymeric material, such as polylactic acid or a grade of Mater-Bi<®> (a commercially available family of starch based copolyesters).

An aerosol-cooling element preferably comprises a sheet of PLA, more preferably a crimped, gathered sheet of PLA. An aerosol-cooling element may be formed from a sheet having a thickness of between 10 micrometer and 250 micrometer, for example 50 micrometer. An aerosol-cooling element may be formed from a gathered sheet having a width of between 150 millimeter and 250 millimeter. An aerosol-cooling element may have a specific surface area of between 300 millimeter$^2$ per millimeter length and 1000 millimeter$^2$ per millimeter length between 10 millimeter$^2$ per mg weight and 100 millimeter$^2$ per mg weight. In some embodiments, the aerosol-cooling element may be formed from a gathered sheet of material having a specific surface area of about 35 millimeter$^2$ per mg weight. An aerosol-cooling element may have an external diameter of between 5 millimeter and 10 millimeter, for example 7 mm.

In some preferred embodiments, the length of the aerosol-cooling element is between 10 millimeter and 15 millimeter. Preferably, the length of the aerosol-cooling element is between 10 millimeter and 14 millimeter, for example 13 millimeter. In alternative embodiments, the length of the aerosol-cooling element is between 15 millimeter and 25 millimeter. Preferably, the length of the aerosol-cooling element is between 16 millimeter and 20 millimeter, for example 18 millimeter.

The elements of the aerosol-forming article, namely the aerosol-forming substrate element and any other elements of the aerosol-generating article such as, for example, a support element, an aerosol-cooling element and a mouthpiece element, are circumscribed by an outer wrapper. The outer wrapper may be formed from any suitable material or combination of materials. Preferably, the outer wrapper is a cigarette paper.

According to another aspect of the invention, there is provided an aerosol-generating system. The aerosol-generating system comprises an aerosol-generating article according to the invention and as described herein. The system further comprises a power source connected to a load network. The load network comprises an inductor for being inductively coupled to the susceptor of the aerosol-generating article.

The inductor may, for example, be embodied as one or more induction coils. If one induction coil only is provided, the single induction coil is inductively coupled to the susceptor material. If several induction coils are provided, each induction coil may heat part of or a section of the susceptor material. The system may comprise an aerosol-generating device comprising a device housing comprising a device cavity arranged in the device housing. The device cavity is adapted to receive the aerosol-generating article or at least the aerosol-forming substrate element comprising the susceptor material. The inductor is provided in the device such that the inductor is inductively coupled to the susceptor material of the aerosol-generating article when the article is positioned in the cavity.

The invention is further described with regard to embodiments, which are illustrated by means of the following drawings, wherein.

Figure 1:
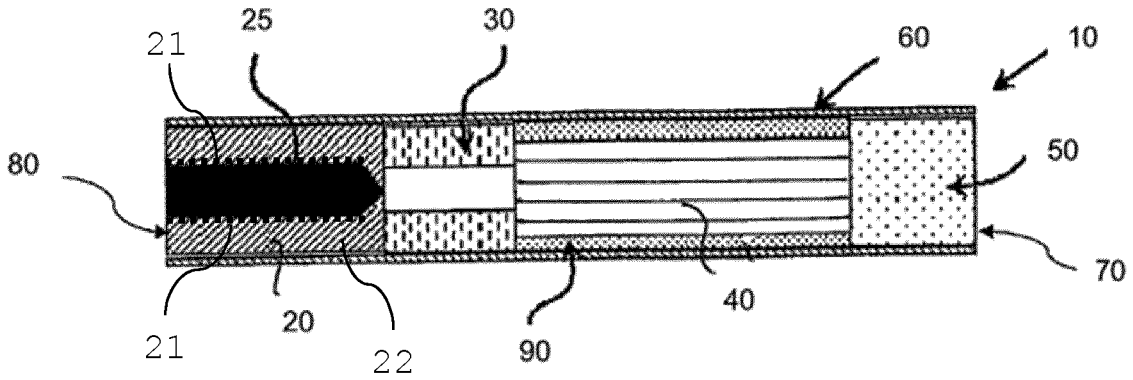
FIG. 1 is a schematic illustration of a longitudinal cross-section of an aerosol-generating article.

The aerosol-generating article 10 of FIG. 1 comprises four elements arranged in coaxial alignment: an aerosol-forming substrate element 20, a support element 30, an aerosol-cooling element 40, and a mouthpiece 50. Each of these four elements is a substantially cylindrical element, each having substantially the same diameter. These four elements are arranged sequentially and are circumscribed by an outer wrapper 60 to form a cylindrical rod. A blade-shaped susceptor 25 is located within the aerosol-forming substrate element. The susceptor is coated with an aerosol-forming substrate coating 21 and arranged in aerosol-forming substrate bulk 22.

The susceptor 25 has a length that is approximately the same as the length of the aerosol-forming substrate element 20, and is located along a radially central axis of the aerosol-forming substrate element 20.

The susceptor 25 is a ferritic iron material having a length of 8 mm, a width of 3 mm and a thickness of 1 mm. One or both ends of the susceptor may be sharpened or pointed to facilitate insertion into the aerosol-forming substrate. If coated on both sides, an area of about 48=$^2$ of the susceptor is covered with the aerosol-forming substrate coating 21.

The aerosol-forming substrate coating 21 comprises tobacco and preferably glycerol or propylene glycol as aerosol-former.

The aerosol-forming substrate bulk 22 comprises a gathered sheet of crimped homogenised tobacco material circumscribed by a wrapper. The crimped sheet of homogenised tobacco material comprises glycerol or propylene glycol as aerosol-former.

The aerosol-generating article 10 has a proximal or mouth end 70, which a user inserts into his or her mouth during use, and a distal end 80 located at the opposite end of the aerosol-generating article 10 to the mouth end 70. Once assembled, the total length of the aerosol-generating article 10 is about 45 mm and the diameter is about 7.2 mm.

In use air is drawn through the aerosol-generating article by a user from the distal end 80 to the mouth end 70. The distal end 80 of the aerosol-generating article may also be described as the upstream end of the aerosol-generating article 10 and the mouth end 70 of the aerosol-generating article 10 may also be described as the downstream end of the aerosol-generating article 10.

The aerosol-forming substrate element 20 is located at the extreme distal or upstream end 80 of the aerosol-generating article 10.

The support element 30 is located immediately downstream of the aerosol-forming substrate element 20 and abuts the aerosol-forming substrate element 20. In FIG. 1, the support element 30 is a hollow cellulose acetate tube. The support element 30 locates the aerosol-forming substrate element 20 in the aerosol-generating article 10. Thus, the support element 30 helps prevent the aerosol-forming substrate element 20 from being forced downstream within the aerosol-generating article 10 towards the aerosol-cooling element 40, for example upon inserting the article into a device. The support element 30 also acts as a spacer to space the aerosol-cooling element 40 of the aerosol-generating article 10 from the aerosol-forming substrate element 20.

The aerosol-cooling element 40 is located immediately downstream of the support element 30 and abuts the support element 30. In use, volatile substances released from the aerosol-forming substrate coating 21 or bulk 22 of the aerosol-forming substrate element 20 pass along the aerosol-cooling element 40 towards the mouth end 70 of the aerosol-generating article 10. The volatile substances may cool within the aerosol-cooling element 40 to form an aerosol that is inhaled by the user. In FIG. 1, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In FIG. 1, the mouthpiece 50 comprises a conventional cellulose acetate tow filter of low filtration efficiency.

To assemble the aerosol-generating article 10, the four cylindrical elements described above are aligned and tightly wrapped within the outer wrapper 60. In FIG. 1, the outer wrapper is a conventional cigarette paper.

Upon manufacturing the article, the four elements may be assembled and wrapped by the wrapper 60. The coated susceptor may then be inserted into the distal end 80 of the assembly such that it penetrates the aerosol-forming substrate bulk 22. As an alternative method of assembly, the coated susceptor 25 is inserted into the aerosol-forming substrate bulk 22 prior to the assembly of the plurality of elements to form a rod.

The aerosol-generating article 10 of FIG. 1 is designed to engage with an electrically-operated aerosol-generating device comprising an induction coil, or inductor, in order to be consumed by a user.

Figure 2:
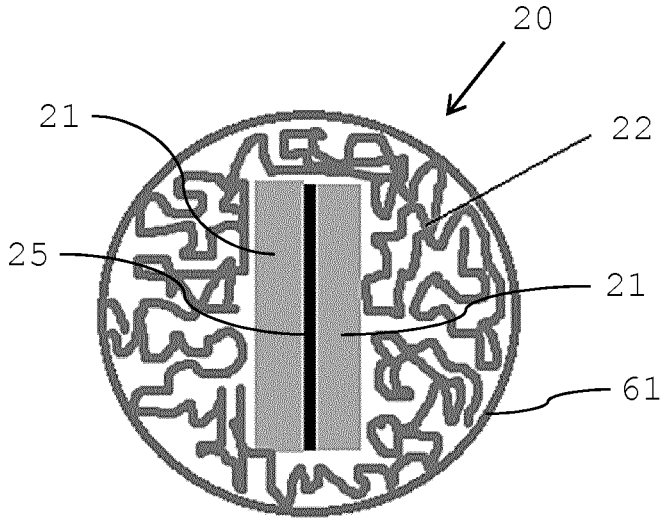
FIG. 2 is a schematic illustration of a cross-section through an aerosol-forming substrate element.

FIG. 2 shows a cross section through a rod-shaped aerosol-forming substrate element, for example of an aerosol-generating article as shown in FIG. 1. The same or similar elements are provided with the same reference numbers.

The blade-shaped susceptor 25 is coated on its two longitudinal flat sides with an aerosol-forming substrate coating 21. The aerosol-forming substrate coating 21 is in direct contact with the susceptor 25. Preferably, the coating 21 is a dense tobacco containing coating. The coating 21 has a thickness of about 100 micrometer on each side of the susceptor blade 25. The coated susceptor 25 is arranged radially centrally within a gathered cast leaf, which is wrapped with a paper wrapper 61 forming a rod-shaped aerosol-forming substrate element.

The invention claimed is:

1. Aerosol-generating article comprising a plurality of elements assembled in the form of a rod, the plurality of elements comprising an aerosol-forming substrate element, with an aerosol-forming substrate bulk and with a susceptor material arranged within the aerosol-forming substrate element, wherein the susceptor material comprises an aerosol-forming substrate coating.

2. Aerosol-generating article according to claim 1, wherein the susceptor material is a plurality of susceptor particles.

3. Aerosol-generating article according to claim 1, wherein the susceptor material is an elongate susceptor arranged longitudinally within the aerosol-forming substrate element.

4. Aerosol-generating article according to claim 3, wherein the elongate susceptor is arranged radially centrally within the aerosol-forming substrate element.

5. Aerosol-generating article according to claim 3, wherein the elongate susceptor has a flat shape forming two large sides, and wherein the aerosol-forming substrate coating is provided on at least one of the two large sides of the elongate susceptor.

6. Aerosol-generating article according to claim 5, wherein the aerosol-forming substrate coating is provided on both of the two large sides of the elongate susceptor.

7. Aerosol-generating article according to claim 1, wherein the susceptor material is entirely coated with the aerosol-forming substrate coating.

8. Aerosol-generating article according to claim 1, wherein a thickness of the aerosol-forming substrate coating is between 50 micrometer and 120 micrometer.

9. Aerosol-generating article according to claim 1, wherein the aerosol-forming substrate coating on the susceptor material is performed by one of deposition, dip-coating, spraying, painting or casting of an aerosol-forming substrate slurry onto an uncoated susceptor material.

10. Aerosol-generating article according to claim 1, wherein the susceptor material comprises a surface area of at least 30 $mm^2$, which is coated with the aerosol-forming substrate coating.

11. Aerosol-generating article according to claim 1, wherein at least one of the aerosol-forming substrate bulk and the aerosol-forming substrate coating comprises tobacco material.

12. Aerosol-generating article according to claim 1, wherein the aerosol-forming substrate bulk comprises a gathered sheet of homogenised tobacco material.

13. Aerosol-generating system comprising:

an aerosol-generating article according to claim 1; and a power source connected to a load network, the load network comprising an inductor for being inductively coupled to the susceptor material of the aerosol-generating article.

14. Aerosol-generating article according to claim 4, wherein the elongate susceptor has a flat shape forming two large sides, and wherein the aerosol-forming substrate coating is provided on at least one of the two large sides of the elongate susceptor.

15. Aerosol-generating article according to claim 14, wherein the aerosol-forming substrate coating is provided on both of the two large sides of the elongate susceptor.

* * * * *